US009611022B2

(12) United States Patent
Matsumoto

(10) Patent No.: US 9,611,022 B2
(45) Date of Patent: Apr. 4, 2017

(54) AIR INTAKE STRUCTURE FOR OUTBOARD MOTOR

(71) Applicant: SUZUKI MOTOR CORPORATION, Shizuoka-Ken (JP)

(72) Inventor: Shingo Matsumoto, Shizuoka-Ken (JP)

(73) Assignee: Suzuki Motor Corporation (JP)

( * ) Notice: Subject to any disclaimer, the term of this patent is extended or adjusted under 35 U.S.C. 154(b) by 25 days.

(21) Appl. No.: 14/442,958

(22) PCT Filed: Oct. 25, 2013

(86) PCT No.: PCT/JP2013/078921

§ 371 (c)(1),
(2) Date: May 14, 2015

(87) PCT Pub. No.: WO2014/077104

PCT Pub. Date: May 22, 2014

(65) Prior Publication Data

US 2015/0298781 A1 Oct. 22, 2015

(30) Foreign Application Priority Data

Nov. 19, 2012 (JP) ..... 2012-253424
Nov. 19, 2012 (JP) ..... 2012-253425
Nov. 19, 2012 (JP) ..... 2012-253426

(51) Int. Cl.
*F02M 35/16* (2006.01)
*F02B 61/04* (2006.01)
(Continued)

(52) U.S. Cl.
CPC ..... *B63H 20/001* (2013.01); *B63H 20/32* (2013.01); *F02M 35/048* (2013.01);
(Continued)

(58) Field of Classification Search
CPC .... B63H 20/001; B63H 20/32; F02M 35/088; F02M 35/048; F02M 35/10013; F02M 35/10; F02M 35/167; F02B 61/045
(Continued)

(56) References Cited

U.S. PATENT DOCUMENTS 5,340,343 A 8/1994 Kawamukai et al.
6,899,579 B1 5/2005 Bruestle
2006/0105648 A1 5/2006 Nagashima et al.

FOREIGN PATENT DOCUMENTS

EP 1 182 337 A2 2/2002
EP 2 489 868 A1 8/2012
(Continued)

OTHER PUBLICATIONS

Search Report for International Patent Application No. PCT/JP2013/078921; Jan. 21, 2014.
(Continued)

*Primary Examiner* — Anthony Wiest
(74) *Attorney, Agent, or Firm* — Barnes & Thornburg LLP

(57) ABSTRACT

An air intake structure for an outboard engine wherein air which is taken in from an air intake opening provided in an engine cover for covering the upper part of the outboard engine is supplied to and sucked into a throttle body. The engine cover has an air intake opening which is open at the front of the outboard engine in the forward movement direction and a lid member which can open and close the air intake opening. A space which connects the air intake opening and the throttle body is provided separated from an engine room.

9 Claims, 7 Drawing Sheets

(51) Int. Cl.

| | |
|---|---|
| ***B63H 20/00*** | (2006.01) |
| ***B63H 20/32*** | (2006.01) |
| ***F02M 35/10*** | (2006.01) |
| ***F02M 35/04*** | (2006.01) |
| ***F02M 35/08*** | (2006.01) |

(52) U.S. Cl.
CPC ..... *F02M 35/088* (2013.01); *F02M 35/10* (2013.01); *F02M 35/10013* (2013.01); *F02M 35/167* (2013.01); *F02B 61/045* (2013.01)

(58) Field of Classification Search
USPC ..... 440/77, 88 A
See application file for complete search history.

(56) References Cited

FOREIGN PATENT DOCUMENTS

| | | | |
|---|---|---|---|
| JP | 02063995 | A | 3/1990 |
| JP | 2006142965 | A | 6/2006 |
| JP | 2007008416 | A | 1/2007 |
| JP | 2008088881 | A | 4/2008 |
| JP | 2012171383 | A | 9/2012 |

OTHER PUBLICATIONS

Extended European Search Report for European Patent Application No. EP 13854602.3 dated Jun. 28, 2016.

AIR INTAKE STRUCTURE FOR OUTBOARD MOTOR

PRIORITY CLAIM

This patent application is a U.S. National Phase of International Patent Application No. PCT/JP2013/078921, filed 25 Oct. 2013, which claims priority to Japanese Patent Application Nos. 2012-253424, 2012-253425, and 2012-253426, all filed 19 Nov. 2012, the disclosures of which are incorporated herein by reference in their entirety.

TECHNICAL FIELD

The present invention relates to an air intake structure configured to supply combustion air to an engine mounted in an outboard motor.

BACKGROUND ART

In an outboard motor provided with an internal combustion engine housed in an engine room formed by an engine cover, there is known a structure in which an opening portion used to take in combustion air is provided behind the engine cover (see, for example, Patent Documents 1 and 2). In such an outboard motor, the air taken into the engine cover is fed into the engine room. Then, the air is delivered to the combustion chamber after flowing through a space near the engine housed in the engine room.

PRIOR ART DOCUMENTS

Patent Documents

Patent Document 1: Japanese Patent Laid-Open Publication No. 2007-8416

Patent Document 2: Japanese Patent Laid-Open Publication No. 2008-88881

SUMMARY OF INVENTION

Problems to be Solved by the Invention

However, with the structure mentioned above, since the opening portion is provided that opens in a direction rearward of the engine cover, i.e., in a rear direction opposite to a forward direction of the outboard motor, air is taken in against a flow of air flowing outside the outboard motor with respect to the intake air. This manner of air intake provides a problem such that a negative pressure produced around the opening portion by the flow of air flowing outside the outboard motor during high-speed navigation acts as intake resistance, which degrades air intake efficiency and results in reduction of an engine power.

Moreover, with the above-mentioned structure, the air taken into the engine cover is heated while flowing near the engine, then drawn into a throttle body, and sent to the combustion chamber, thus degrading charging efficiency, which will result in poor combustion efficiency and fuel economy.

The present invention has been made in view of the circumstances mentioned above and an object thereof is to provide an air intake structure for an outboard motor capable of improving air intake efficiency and charging efficiency for achieving excellent combustion efficiency.

Means for Solving the Problems

One embodiment provided for achieving the above object is an air intake structure for an outboard motor, in which air is taken in through an air intake port formed in an engine cover covering upper portion of the outboard motor and the air is delivered to a throttle body in order for the air to be drawn into the throttle body, wherein the engine cover is provided with an air intake port opened forward in an advancing direction of an outboard motor and a lid member configured to open and close the air intake port, and a space configured to communicate the air intake port and the throttle body with each other is provided so as to be isolated from an engine room.

In the above one embodiment, the following preferred exemplary modes may be provided.

The lid member configured to open and close the air intake port may be a louver.

It may be preferred that a bulging portion is formed on an upper surface of the cover so as to protrude therefrom, an expansion chamber is provided inside the engine cover with an inner space formed by the bulging portion, and the expansion chamber configured to convert dynamic pressure of the air taken in through the air intake port into static pressure.

It may be desired that a separator that performs gas/liquid separation is provided at an intermediate portion of an air passage in the space, and the separator includes a flat-plate portion configured to cover an upper portion of an air inlet of the throttle body and a skirt portion formed by extending a front end portion of the flat-plate portion downward.

It may be desired that the throttle body may be disposed rearward of the air intake port with a space from the air intake port.

It may be preferred that a drain passage is provided so as to communicate an inner portion of the space with an outside portion and discharge water from the inner portion of the space to the outside portion, a backflow prevention mechanism is provided to the drain passage so as to prevent water from flowing into the inner portion of the space from the outside portion, and the backflow prevention mechanism is composed of at least one of an S-shaped pipe and a one-way valve.

In another embodiment of the present invention, it may be preferred that the lid member of the air intake port is pivotally coupled, at a front portion thereof, with the engine cover at a front portion of the engine covering the upper portion of the outboard motor, the lid member has a rear portion configured to turn inward of the engine cover to allow the air intake port to be opened forward in the advancing direction of the outboard motor.

In a further embodiment of the present invention, it may be also preferred that the lid member of the air intake port is pivotally coupled, at a rear portion thereof, with the engine cover at a front portion of the engine covering the upper portion of the outboard motor, the lid member has a rear portion configured to turn outward of the engine cover to allow the air intake port to be opened forward in the advancing direction of the outboard motor.

In the above another and further embodiments, the following exemplary modes may be provided.

It may be preferred that the air intake port facing forward in the advancing direction of the outboard motor is set to be a first air intake port, a second air intake port is further provided on a rear side of the engine cover, an open/close member pivotally coupled to the inner portion of the engine cover is provided so as to open and close the second air intake port, and a space that communicates the first air intake port and the second air intake port with the throttle body is provided so as to be isolated from the engine room.

It may be preferred that an expansion chamber is provided inside the engine cover and configured to convert dynamic pressure of the air taken in through the first air intake port into static pressure.

It may be preferred that a separator that performs gas/liquid separation is provided at an intermediate portion of an air passage in the space, and the separator includes a flat-plate portion configured to cover an upper portion of an air inlet of the throttle body and a skirt portion formed by extending a front end portion of the flat-plate portion downward.

It may be preferred that the throttle body is disposed rearward of the air intake port with a space from the air intake port.

It may be further preferred that a drain passage is provided so as to communicate an inner portion of the space with an outside portion and discharge water from the inner portion of the space to the outside portion, a backflow prevention mechanism is provided to the drain passage so as to prevent water from flowing into the inner portion of the space from the outside portion, and the backflow prevention mechanism is composed of at least one of an S-shaped pipe and a one-way valve.

Effects of the Invention

According to the intake structure of the outboard motor of present invention of the characters mentioned above, since the air intake efficiency and air charging efficiency can be improved, the excellent combustion efficiency can also be achieved.

Further functions and effects of the above-mentioned embodiments of the present invention will become apparent from the following description made with reference to preferred embodiments illustrated in the accompanying drawings.

BRIEF DESCRIPTION OF THE DRAWINGS

FIG. 3 includes FIGS. 3A and 3B as schematic sectional views showing an engine cover and its surroundings including an air intake structure according to a first embodiment of the present invention of the outboard motor, in which

FIG. 4 includes FIGS. 4A and 4B as schematic sectional views showing an engine cover and its surroundings including an air intake structure (open) according to a second embodiment of the present invention of the outboard motor, in which

FIG. 5 includes FIGS. 5A and 5B as schematic sectional views showing the engine cover and its surroundings including the air intake structure (closed) according to the second embodiment of the present invention of the outboard motor, in which

FIG. 6 includes FIGS. 6A and 6B as schematic sectional views showing an engine cover and its surroundings including an air intake structure (open) according to a third embodiment of the present invention of the outboard motor, in which

FIG. 7 includes FIGS. 7A and 7B as schematic sectional views showing the engine cover and its surroundings including the air intake structure (closed) according to the third embodiment of the present invention of the outboard motor, in which

EMBODIMENTS FOR EMBODYING THE INVENTION

The present invention has been conceived in consideration of the conventional techniques described hereinbefore and provides an air intake structure for an outboard motor, capable of improving air intake efficiency and charging efficiency to thereby achieve excellent combustion efficiency. According to a preferred embodiment of the present invention, the air intake structure takes in air through an air intake port provided in an engine cover and delivers the air to a throttle body in order for the air to be drawn into the throttle body, wherein the air intake port is configured to open forward in a advancing direction of the outboard motor, being configured to be capable of being opened and closed, and a space for communicating the air intake port and the throttle body with each other is provided apart from an engine room.

Hereunder, an embodiment of the present invention will be described in detail with reference to the accompanying drawings.

Figure 1:
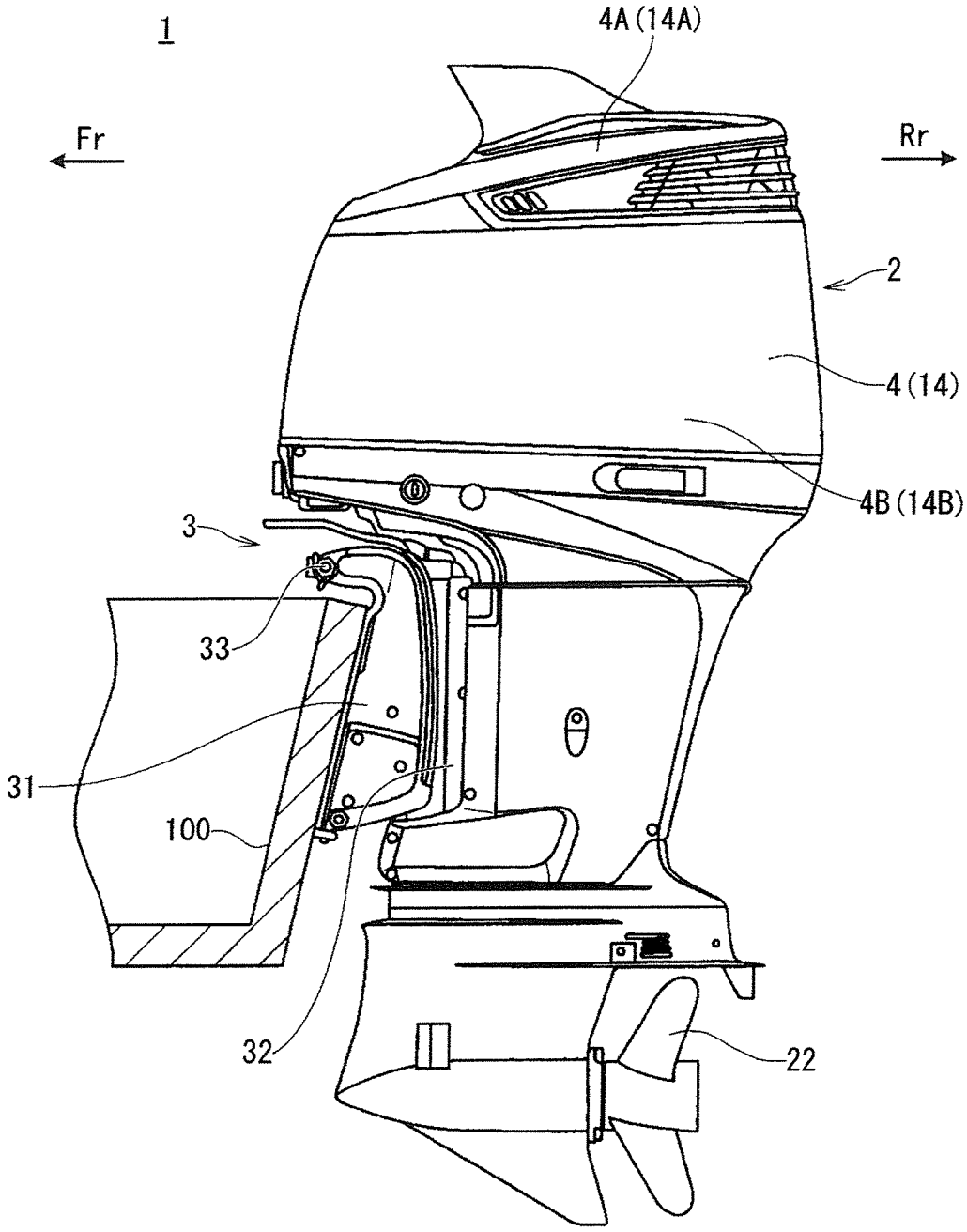
FIG. 1 is a left side view showing an appearance of an outboard motor according to the present embodiment.
Figure 2:
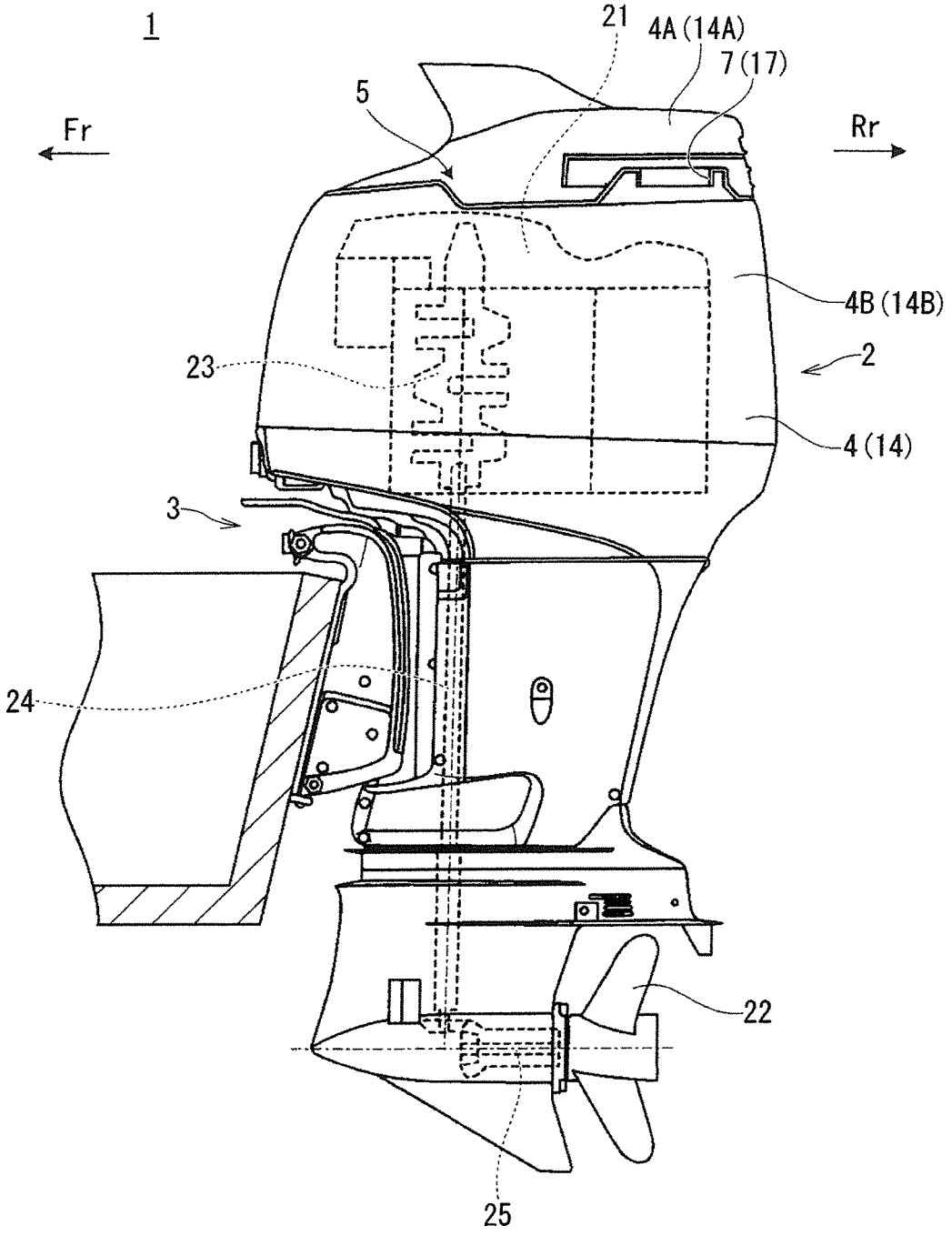
FIG. 2 is a left side view showing a schematic structure inside the outboard motor.

FIGS. 1 and 2 are common to all exemplary embodiments, where FIG. 1 is a left side view showing an appearance of an outboard motor 1 provided with an air intake structure according to an embodiment of the present invention and FIG. 2 is a left side view showing a schematic structure of the outboard motor 1 provided with the air intake structure according to the embodiment of the present invention. It is further to be noted, for the sake of convenience of explanation, that the forward direction of the outboard motor 1 is indicated by arrow Fr while the rearward direction of the outboard motor 1 is indicated by arrow Rr.

First Embodiment (FIGS. 1, 2, and 3)

A first Embodiment of the present invention will be described hereunder with reference to accompanying drawings, i.e., FIGS. 1 to 3.

The outboard motor 1 includes an outboard motor body 2 and a mounting bracket unit 3 in which the outboard motor body 2 produces a propulsive force when a driving force of an engine 21 (see FIG. 2) mounted in the outboard motor 1 is transmitted to a propeller 22, and the mounting bracket unit 3 is used to attach the outboard motor body 2 to a stern portion (transom) 100 of a boat or ship.

As shown in FIG. 2, the outboard motor body 2 includes the engine 21 disposed to an upper portion thereof so as to drive the propeller 22 disposed at a lower portion. As the engine 21, for example, a multi-cylinder engine such as a V-6 engine can be adopted, and herein, detailed description of an internal structure of the engine 21 will be omitted.

The entire outboard motor body 2 is covered with an outer cover. In particular, the engine 21 is covered with an engine cover 4 as an outer covering. The engine cover 4 is composed of an upper engine cover 4A and a lower engine cover 4B joined integrally, in which the upper engine cover 4A is an upper cover or top cover configured to cover an upper part of the engine 21 while the lower engine cover 4B is a bottom cover or lower cover. The engine room in which the engine 21 is housed is composed of an enclosed structure by the engine cover 4 so as to be shut off from outside air.

An under plate (underplate) 5 (described later) is disposed between the upper engine cover 4A and lower engine cover 4B. The engine 21 is arranged in the engine room formed by the under plate 5 and lower engine cover 4B. A space formed by the upper engine cover 4A is substantially isolated, i.e., separated, from the engine room by the under plate 5.

The engine 21 is mounted to take a vertical position so that a crank shaft 23 faces in a perpendicular direction. The crank shaft 23 is coupled with a drive shaft 24, and the propeller 22 is mounted on one end of a propeller shaft 25. According to such structure, a rotational force of the engine 21 is transmitted to the propeller shaft 25 via the drive shaft 24, thereby causing the propeller 22 to rotate in a forward or reverse direction by which a forward or reverse propulsive force is given to a ship to which the outboard motor is mounted.

The engine 21 is connected with a throttle body 200 for controlling a volume of air drawn into the engine 21. An upper end surface of the throttle body 200, i.e., an upper end portion of an air intake channel, is connected to a throttle body connecter (i.e. connecting tube) 7 which is opened upward at a lower side of the engine cover 4A. The throttle body connecter 7 is placed on a rear side of the engine room.

The mounting bracket unit 3 includes a clamp bracket 31 and a swivel bracket 32. The clamp bracket 31 is detachably attached to the stern portion 100 of the ship. The swivel bracket 32 supports the outboard motor body 2 to be pivotal in a horizontal direction and supports the outboard motor body 2 to be pivotal in a vertical direction with respect to the clamp bracket 31 via a swivel shaft 33. According to such structure, the outboard motor body 2 is attached to the ship in a manner capable of swiveling in both the horizontal direction (steering direction) and vertical direction (tilt direction).

Figure 3A:
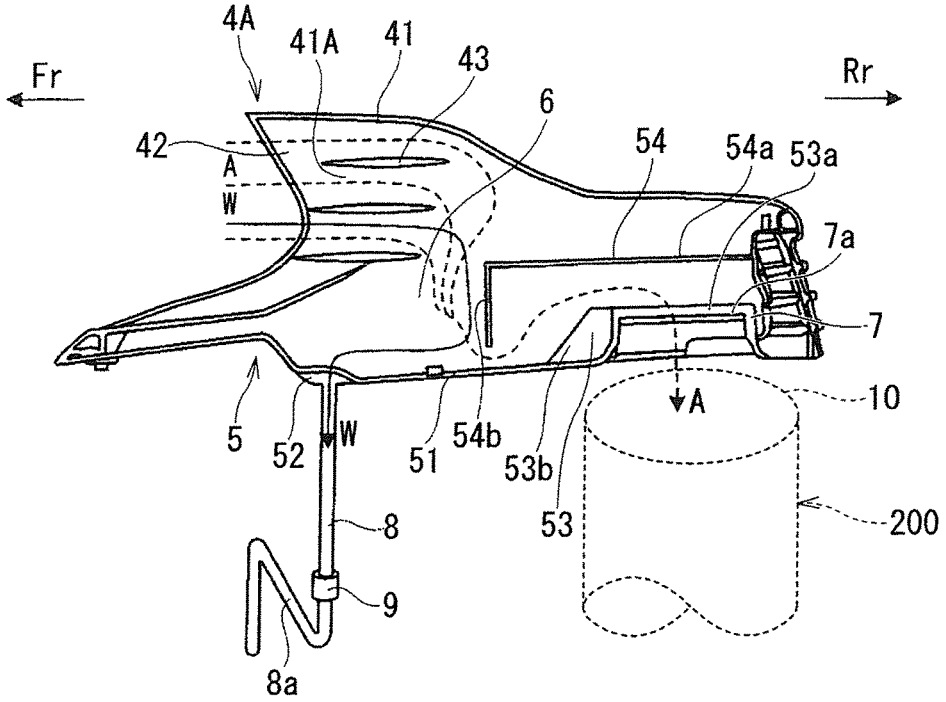
FIG. 3A shows an open state of the air intake structure and FIG. 3B shows a closed state.
Figure 3B:
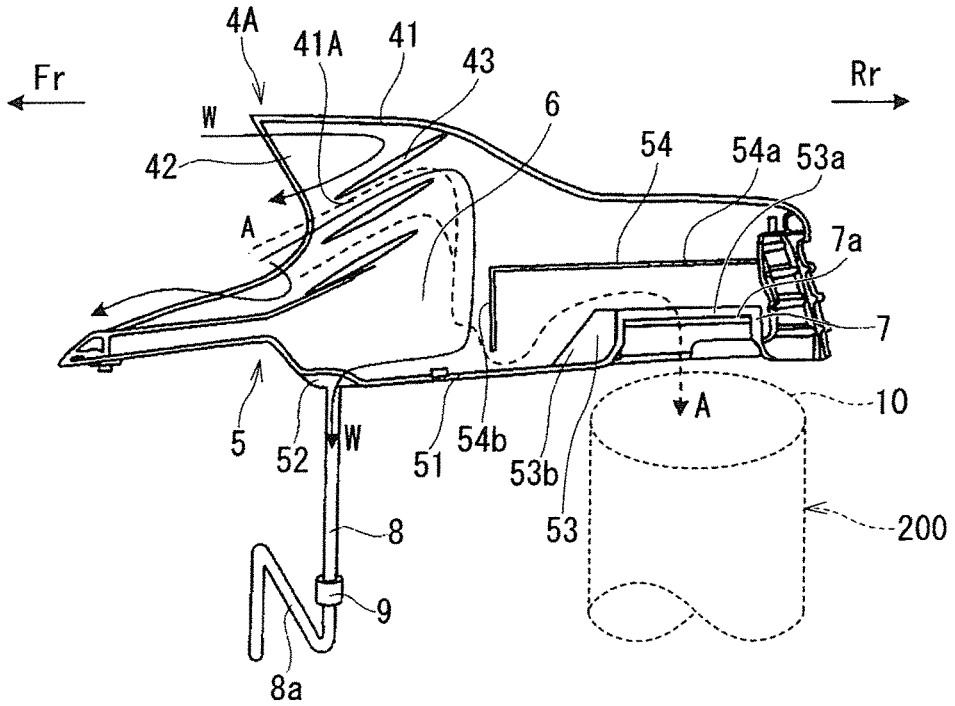

FIGS. 3A and 3B are schematic sectional views showing the upper engine cover 4A and its surroundings. The upper engine cover 4A is made by molding, for example, carbon fiber reinforced plastics (CFRP) or the like. Generally, the upper engine cover 4A has a shape which is opened downward, and the upper engine cover 4A has generally an elliptical shape elongated in a front-and-rear direction (longitudinal direction along the outboard motor body) in a top plan view and is curved convex upward as a whole.

Furthermore, the upper engine cover 4A is provided, on the forward side thereof, with a bulging portion 41 protruding upward, an air intake port 42 formed in a front end portion of the bulging portion 41, and a louver 43 adapted to add an open/close function to the air intake port 42.

The bulging portion 41 has a front end portion having a surface inclining forward slightly from a perpendicular state, and the surface inclines gently downward at its rear end portion while maintaining an upward convex curved shape. The air intake port 42 is provided in the front end portion of the bulging portion 41 to be opened forward, and on a lower front edge of the air intake port 42, an upper (top) surface of the upper engine cover 4A forms a gently inclined surface sloping downward in a forward direction.

The louver 43 serving as a lid member is fitted in the air intake port 42 and used to change an open/closed state of the air intake port 42. By changing orientation of the louver 43, it is possible to adjust an air intake direction and change the open/closed state of the air intake port 42. The louver 43 is located for preventing foreign material from entering through the air intake port 42. In this sense, it may be said that the louver 43 acts as a lid member.

In an open position of the louver 43 shown in FIG. 3A, the louver 43 has plural slit-shaped flow channels arranged up and down and in parallel to each other in the front-and-rear direction of the outboard motor 1, i.e., as a longitudinal direction. Further, in a closed position of the louver 43 shown in FIG. 3B, the louver 43 has plural mutually parallel slit-shaped flow channels inclined with respect to the longitudinal direction of the outboard motor 1. The position of the louver 43 is changed from the opened position shown in FIG. 3A to the closed position shown in FIG. 3B by the pivotal movement thereof through automatic or manual operation so that the rear section is directed obliquely upward.

In the manner mentioned above, the upper engine cover 4A and the bulging portion 41 of the upper top surface of the upper engine cover 4A are formed so as to provide approximately an upward convex curved surface so as to provide a round shape as a whole. An inner side of the bulging portion 41 forms an inner space 41A approximately corresponding to such outer shape so as to be communicated with an outer side through the air intake port 42.

Next, an inner structure of the upper engine cover 4A will be described.

The inner space 41A is formed by the upward convex bulging portion 41 inside the upper engine cover 4A. The under plate 5 is disposed between the upper engine cover 4A and lower engine cover 4B. The under plate 5 is placed under the upper engine cover 4A in an overlapped arrangement so as to close a lower side opening of the upper engine cover 4A. According to such structure, an expansion chamber 6 including the inner space 41A is formed between the upper engine cover 4A and under plate 5. The location of the under plate 5 isolates the expansion chamber 6 from the engine room formed inside the lower engine cover 4B. The expansion chamber 6 attains an effect of converting dynamic pressure of air taken in through the air intake port 42 into static pressure. Since the air taken in through the air intake port 42 can be supplied to the throttle body 200 after converting the dynamic pressure into the static pressure by the expansion chamber 6, combustion air can be supplied to a combustion chamber using a ram pressure produced during sailing.

The under plate 5 is made by molding, for example, carbon fiber reinforced plastics (CFRP) or the like. Further, the under plate 5 has approximately an elliptical shape elongated in the front-and-rear (longitudinal) direction in a top plan view as like as the upper engine cover 4A, and a bottom portion 51 of the under plate 5 curves downward in a convex shape. The bottom portion 51 is formed so as to deepen gradually forward from the rear side. A drain hole 52 and a guide seat 53 for guiding an air flow are provided to the bottom portion 51, and a separator 54 is located above the guide seat 53.

The drain hole 52 is formed in a front end portion of the bottom portion 51 and an upper end of the drain pipe 8 is connected to the drain hole 52. Water collected in the expansion chamber 6 is discharged outside through a drain passage composed of the drain hole 52 and drain pipe 8. Since the drain hole 52 is formed in the front end portion of the bottom portion 51, i.e., at the lowest level in the bottom portion 51, water can be discharged from the drain hole 52 even when the outboard motor 1 is driven in a tilting motion.

A backflow prevention mechanism adapted to prevent backflow of drain is provided at an intermediate portion of the drain passage composed of the drain pipe 8. An S-shaped pipe with a bent portion 8*a* formed by bending or curving the drain pipe 8 may be used as the backflow prevention mechanism. The bent portion 8*a* of the drain pipe 8 has a shape which obstructs the flow of water, thus preventing or restricting the water from flowing backward in the drain pipe 8. Furthermore, since the water flowing backward is attenuated in force by the bent portion 8*a*, it becomes possible to prevent the water from flowing backward into the expansion chamber 6. Moreover, in a case when air containing water flows backward, the water is separated from the air by colliding with an inner wall surface of the bent portion 8*a*, thereby also preventing the water from flowing backward into the expansion chamber 6.

Further, a one-way valve 9 which allows the drain water to pass only in a discharge direction indicated by arrow W shown in FIG. 3 may be disposed as the backflow prevention mechanism. It is further to be noted that the backflow prevention mechanism may be made up of both or only one of the bent portion 8*a* and one-way valve 9.

The guide seat 53 is provided in a manner protruding upward from the bottom portion 51 so as to surround an upper end opening portion 7*a* of the throttle body connecter 7 disposed on a rearward side of the under plate 5. The guide seat 53 has, for example, substantially a truncated cone shape, and an opening portion 53*a* is formed in an upper portion thereof. The opening portion 53*a* is provided corresponding, in position, to the upper end opening portion 7*a* of the throttle body connecter 7, and an outer circumferential surface of the guide seat 53 has an inclined surface 53*b* sloping toward the opening portion 53*a*.

The separator 54 is provided for preventing moisture and the like from entering into the throttle body connecter 7 which is opened upward. The separator 54 includes a flat-plate portion 54*a* configured to cover the opening portion 7*a* of the throttle body connecter 7 from the upper side thereof and a skirt portion 54*b* formed by bending the flat-plate portion 54*a* along a front edge so as to extend downward. A lateral edge portion and a rear edge portion of the flat-plate portion 54*a* are coupled to an inner wall surface of the under plate 5. The separator 54 has a structure such that a rear end portion of the bulging portion 41 is located between a front end portion and a rear end portion of the separator 54.

The skirt portion 54*b* has a structure such that the lower end portion thereof is located below the opening portion 53*a* of the guide seat 53, but above the bottom portion 51 of the under plate 5, and the lower end portion thereof is also located below a lower end portion of the air intake port 42.

Hereunder, a flow of combustion intake air supplied to the engine 21 in the outboard motor 1 having the structure mentioned above will be described.

When a ship (hull) with the outboard motor 1 mounted thereon sails, the outside air flows in through the air intake port 42 provided in the bulging portion 41 of the engine cover 4A. As indicated by the dotted arrow A in FIG. 3A, the air taken in through the air intake port 42 enters the expansion chamber 6 through the inner space 41A inside the bulging portion 41, passes under the skirt portion 54*b* of the separator 54, and is supplied to the throttle body 200 through the opening portion 53*a* of the guide seat 53 and the upper end opening portion 7*a* of the throttle body connecter 7.

At this time, moisture and the like contained in the intake air and water splashes are separated from gas component by colliding with the separator 54 as indicated by the arrow W in FIG. 3A, and fall onto the bottom portion 51 of the under plate 5. In such case, since the bottom portion 51 of the under plate 5 is an inclined surface sloping downward in a forward direction, the water flows down in the forward direction (i.e., in a direction opposite to the throttle body). The water which has flown down is collected in the front section of the bottom portion 51 and then flows down into the drain pipe 8 through the drain hole 52. Thereafter, the water is discharged outside the outboard motor 1.

Thus, even if the moisture and the like intrude into the expansion chamber 6 through the air intake port 42, the moisture and the like are kept from flowing into an air inlet 10 of the throttle body 200 through the upper end opening portion 7*a* of the throttle body connecter 7. In particular, since the opening portion 53*a* of the guide seat 53 is provided near the rear portion of the expansion chamber 6, the water intruding into the expansion chamber 6 flows down in a direction away from the air inlet 10 of the throttle body, thus making it possible to effectively prevent the water from invading into the expansion chamber 6 from flowing toward the air inlet 10 of the throttle body 200 or from stagnating near the air inlet 10 of the throttle body.

Furthermore, since the drain pipe 8 is provided with the backflow prevention mechanism, it is possible to prevent the water once discharged through the drain passage from flowing backward into the expansion chamber 6. In addition, no water will enter or intrude into the expansion chamber 6 through the drain passage from outside the outboard motor 1.

The drain hole 52 is formed so as to be always located in the lowermost section of the bottom portion 51 even when the outboard motor 1 tilts. Consequently, the water entering the expansion chamber 6 can be discharged quickly regardless of an attitude of the outboard motor 1.

Furthermore, the louver 43 is provided inside the air intake port 42 of the outboard motor 1. When the louver 43 is set at a closed position, the moisture and the like contained in the intake air and the water splashes are separated from the gas component by colliding with the louver 43 as indicated by the arrow W in FIG. 3B, and fall onto the lower front edge of the air intake port 42 of the upper engine cover 4A. It is further to be noted that, on the lower front edge of the air intake port 42, since the upper surface of the upper engine cover 4A forms an inclined surface sloping downward in the forward direction, the fallen water droplets and the like are restricted from rising along the upper surface of the upper engine cover 4A, thus making it possible to effectively prevent the moisture and the like from entering through the air intake port 42.

It is also to be noted that the open/close function of the louver 43 serving as a lid member can be controlled manually or automatically, for example, by setting the louver 43 to the open position to take full advantage of ram pressure when the ship is sailing at a high speed, and on the while, by setting the louver 43 to the closed position to prevent the moisture and the like from entering when the ship is sailing at a low speed.

In the outboard motor 1 according to the first embodiment of the present invention, the air intake port 42 is provided in the upper engine cover 4A covering the upper portion of the outboard motor 1 and the air intake port 42 is opened forward. According to such structure, since fresh air can be caused to flow directly into the air intake port 42 when the ship sails, the air intake efficiency is improved greatly in comparison with a structure in which an air intake port is provided behind the engine cover, and consequently, the combustion efficiency of the engine 21 can be improved.

Further, with the air intake structure of the outboard motor 1 according to the present embodiment, in the space inside the upper engine cover 4A, i.e., in the expansion chamber 6, the air taken in through the air intake port 42 is delivered and drawn into the air inlet 10 of the throttle body 200. In such air intake structure, the expansion chamber 6, which is a space communicating the air intake port 42 and the throttle body with each other, is isolated from the engine room by the under plate 5. Therefore, the air intake structure is located above the engine 21 in the engine room apart from the engine 21.

The air taken in through the air intake port 42 enters the expansion chamber 6 and enters below the skirt portion 54*b* of the separator 54 as indicated by the dotted arrow A in FIG. 3A, and the air is supplied to the air inlet 10 of the throttle body through the opening portion 53*a* of the guide seat 53 and the upper end opening portion 7*a* of the throttle body connecter 7. In such manner, the combustion air is supplied from the throttle body 200 to the engine 21 through an air passage in a space isolated from the engine room. That is, since the combustion air is not heated while being delivered to the engine 21 without being exposed to the high temperature engine 21, the intake air charging efficiency becomes high, and it makes possible to improve the combustion efficiency of the engine 21.

Furthermore, even if a large quantity of water intrudes or enters through the air intake port 42, the intruding water drops onto the flat-plate portion 54*a* of the separator 54 and further drops onto the bottom portion 51 of the under plate 5 through the skirt portion 54*b*. Consequently, the water intruding into the expansion chamber 6 will not enter the air inlet 10 of the throttle body 200 directly through the upper end opening portion 7*a* of the throttle body connecter 7. That is, the flat-plate portion 54*a* of the separator 54 attains a function as ceiling walls of the throttle body connecter 7 and throttle body air inlet 10 and functions as a shield plate against the intruding water, thereby achieving a high prevention effect against the water intrusion. Further, since the lateral edge and rear edge of the flat-plate portion 54*a* are coupled to the inner wall surface of the under plate 5, no water will intrude through the lateral edge and rear edge of the flat-plate portion 54*a*.

Still furthermore, it is possible to prevent an event of intrusion of a large quantity of water through the air intake port 42 by controlling the open/close function of the louver 43 fitted in the air intake port 42. That is, by setting the louver 43 to the closed position and by being equipped with the separator 54, it is possible to achieve the high prevention effect against water intrusion into the throttle body connecter 7 and throttle body air inlet 10. A degree of opening/closing of the louver 43 can be adjusted according to a sailing speed of the ship and condition of water surface.

Still furthermore, the air intake port 42 is formed in the bulging portion 41 provided so as to protrude from the upper (top) surface of the upper engine cover 4A. By making the bulging portion 41 protrude from the upper top surface of the upper engine cover 4A, an air flow colliding with the bulging portion 41 is received once to thereby create a stagnant state of the air at the air intake port 42. Basically, there is no such stagnant state on an outer side or near an outer periphery of the air intake port 42, in which the air flows at relatively high velocity. Because of such reason, water splashes and the like drift away from the air intake port 42 by being pulled by the air flow on the outer side at which the flow velocity is high. In this viewpoint, the splash intrusion prevention effects will be effectively achieved.

As mentioned above, by opening forward the air intake port 42 is open forward, it is made easier to take in air while keeping splashes and the like other than intake air away from the air intake port 42, thus also achieving the high air intake performance.

Furthermore, since the air intake port 42 is provided in the top upper surface of the upper engine cover 4A covering the upper portion of the outboard motor 1, the air intake port 42 is located at the highest level of the outboard motor 1. This structure minimizes obstacles and the like against incoming air in front of the air intake port 42, thereby providing smooth incoming air flow at the air intake port 42. Moreover, since the air intake port 42 is located at a higher level from the water surface, it is possible to effectively prevent sea spray and the like from intruding.

Still furthermore, in the outboard motor 1, the throttle body 200 is disposed rearward of the air intake port 42 with a space from the air intake port 42. That is, the air intake port 42 is located on the forward side of the engine cover 4A, and on the other hand, the throttle body connecter 7 is located on the rearward side of the engine cover 4A. According to such location, since a large distance is maintained between the air intake port 42 and throttle body 200, the air passage for the intake air is increased according to the spacing distance, and it becomes easier to separate the moisture and the like contained in the intake air, which makes it possible to effectively prevent the water from entering into the throttle body. Further, by increasing the spacing distance between the air intake port 42 and throttle body 200, it becomes also possible to increase the inner volume of the expansion chamber 6 to thereby increase the charging efficiency of intake air.

Still furthermore, the bulging portion 41 is provided in the upper top surface of the upper engine cover 4A covering the upper portion of the outboard motor 1 in a manner such that the rear end portion of the bulging portion 41 is located between the front end and rear end of the separator 54. Moreover, the air intake port 42 is formed in the front end portion of the bulging portion 41, and the lower end portion of the air intake port 42 is positioned above the lower end portion of the skirt portion 54*b* of the separator 54. According to such structure or arrangement, even if a large quantity of water intrudes through the air intake port 42, the intruding water can be caused to drop reliably onto a top surface of the flat-plate portion 54*a* of the separator 54. Furthermore, the water intruding through the air intake port 42 contacts the flat-plate portion 54*a* or skirt portion 54*b* of the separator 54 before dropping onto the bottom portion 51 of the under plate 5. Therefore, it becomes possible to avoid an event such that the large quantity of water intruding through the air intake port 42 directly drops onto the bottom portion 51 of the under plate 5, and also an event such that the water splashes will enter or intrude into the upper end opening portion 7*a* of the throttle body connecter 7.

Second Embodiment (FIGS. 1, 2, 4 and 5)

A second embodiment of the present invention will be described hereunder with reference to FIGS. 1, 2, 4, and 5.

It is to be noted that description of common components with those of the first embodiment (FIGS. 1 and 2) will be omitted or simplified herein.

Figure 4A:
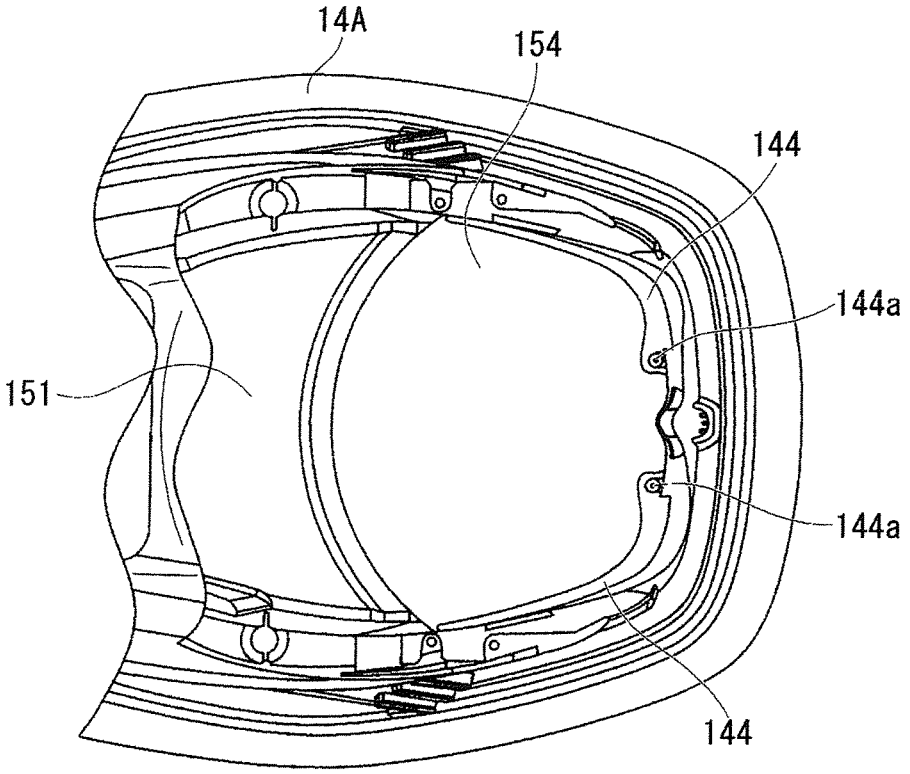
FIG. 4A is a schematic sectional view taken along the line IVA-IVA in FIG. 4B.
Figure 4B:
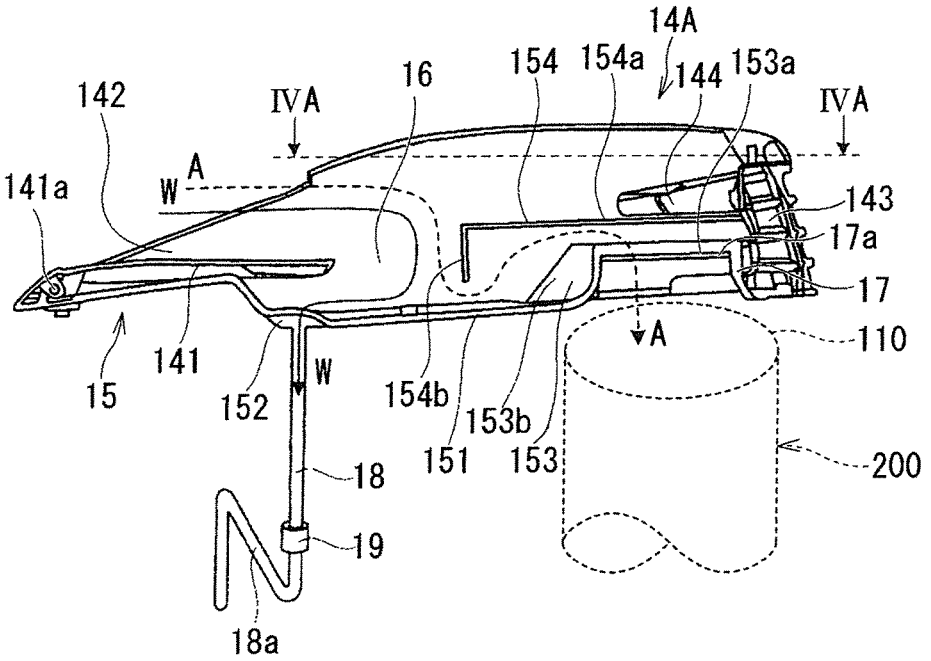
Figure 5A:
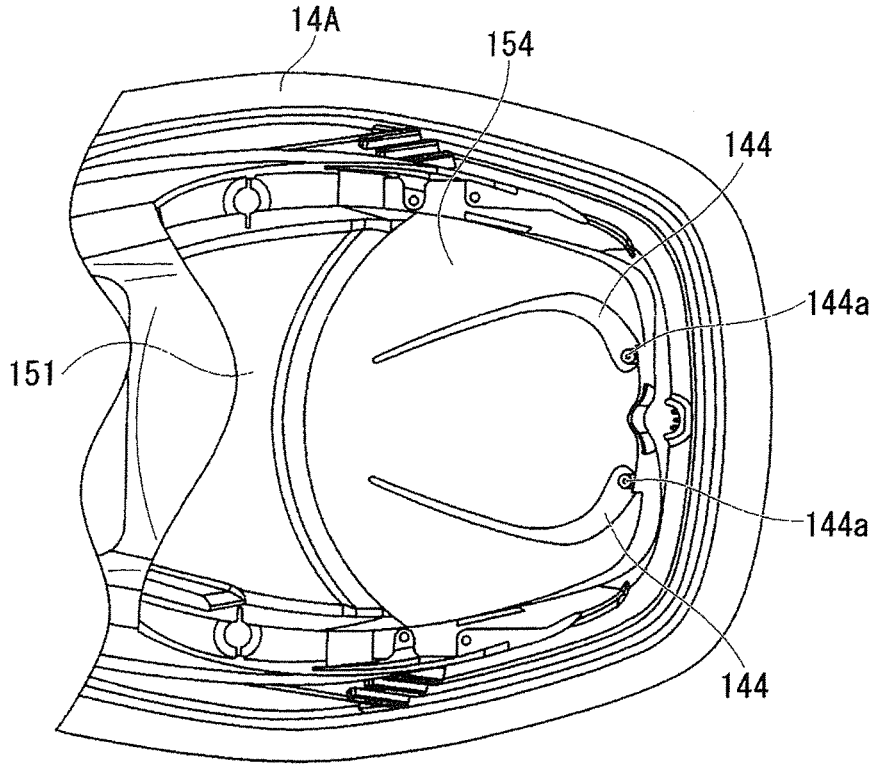
FIG. 5A is a schematic sectional view taken along the line VA-VA in FIG. 5B.
Figure 5B:
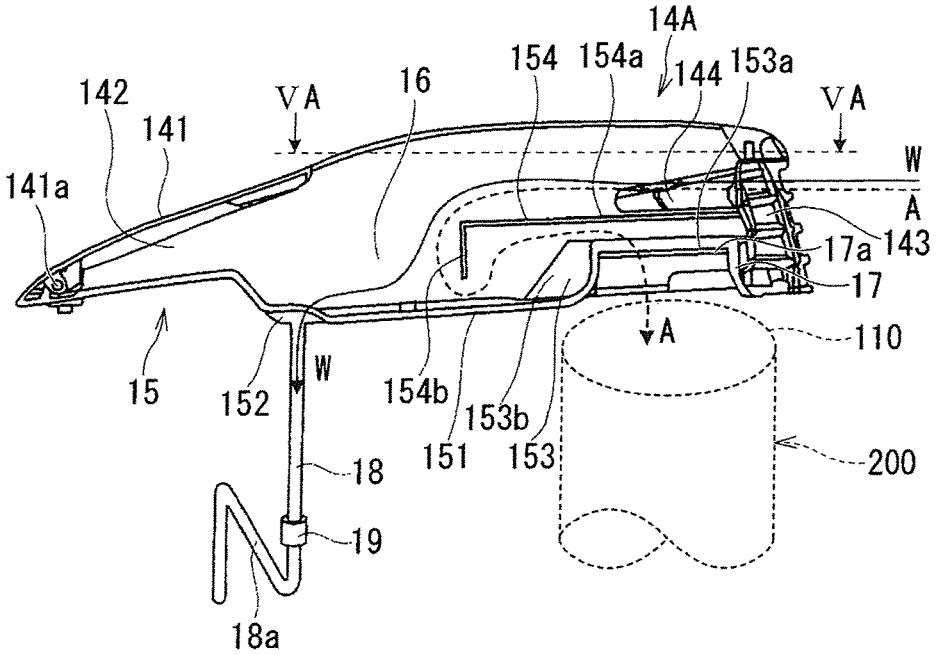

FIGS. 4 and 5 are schematic sectional views showing an upper engine cover 14A and its surroundings. FIG. 4A is a schematic sectional view taken along the line IVA-IVA in FIG. 4B. FIG. 5A is a schematic sectional view taken along the line VA-VA in FIG. 5B. The upper engine cover 14A is made by molding, for example, carbon fiber reinforced plastics (CFRP) or the like. Generally, the upper engine cover 14A has a shape opened downward, and the upper engine cover 14A generally has an elliptical shape elongated in the front-and-rear (longitudinal) direction in a top plan view and is curved in form of convex upward as a whole.

On the front side of the upper engine cover 14A, a lid member 141 constituting a part of the cover is coupled to an inner side of the upper engine cover 14A so as to be pivotal (open/close) inward by means of hinge 141*a*. At the open position shown in FIG. 4B, the lid member 141 pivoting downward to the inner side around the hinge 141*a* is fixed by opening forward the front side of the upper engine cover 14A. At this time, a first air intake port 142 formed in the upper engine cover 14A takes the opened position. On the other hand, at the closed position shown in FIG. 5B, the lid member 141 pivoting upward to the inner side around the hinge 141*a* is fixed by closing the front side of the upper engine cover 14A. At this time, the first air intake port 142 formed in the upper engine cover 14A takes the closed position.

On the other hand, the upper engine cover 14A has, to the rear end portion thereof, plural slit-shaped second air intake ports 143 substantially parallel to one another in an up-and-down direction of the outboard motor 1. An open/close member 144 adapted to add an open/close function to the second air intake ports 143 is provided in the upper engine cover 14A. The open/close member 144 is fitted on the second air intake ports 143 to change or switch the open/close state of the second air intake ports 143. At the closed position shown in FIG. 4A, the open/close member 144 is fixed by closing the second air intake ports 143. At this time, the second air intake ports 143 formed in the upper engine cover 14A become closed. Further, in the opened position shown in FIG. 5A, the open/close member 144 pivotally moves inward around the hinge 141*a* and is fixed by opening the second air intake ports 143. At this time, the second air intake ports 143 formed in the upper engine cover 14A become opened.

The upper engine cover 14A is generally formed with an upward convex curved surface or curved line to provide an outer round shape as a whole. The inner side of the upper engine cover 14A has a hollow structure approximately corresponding to the outer round shape so that the inner and outer sides of the upper engine cover 14A are communicated with each other through the first air intake port 142 and second air intake ports 143.

Next, an inner structure of the engine cover 14 according to the second embodiment will be described.

According to the present second embodiment, as like as the first embodiment, the under plate 15 is disposed between the upper engine cover 14A and the lower engine cover 14B. The under plate 15 is disposed below the upper engine cover 14A in an overlapped manner so as to close an opening on the lower side of the upper engine cover 14A, thus forming the expansion chamber 16. By providing the under plate 15, the expansion chamber 16 attains a function of converting dynamic pressure of the air taken in through the first air intake port 142 into static pressure. In the expansion chamber 16, since the air taken in through the first air intake port 142 can be supplied to the throttle body 200 after the conversion of the dynamic pressure into the static pressure, the combustion air can be supplied to a combustion chamber using a ram pressure produced during the sailing of a ship.

Since material and shape forming the under plate 15, and associated portions thereof are substantially identical or similar to those of the first embodiment, description thereof will be omitted herein. Further, it is to be noted that components in this second embodiment corresponding to those of the first embodiment are denoted by adding 10 or 100 to the reference numerals added to those of the first embodiment in the accompanying drawings (for example, under plate 5□ under plate 15, lid member 41□ lid member 141, and so on).

Next, description will be given of a flow of combustion air supplied to the engine 21 in the outboard motor 1 according to the second exemplary embodiment configured as described above.

When the lid member 141 of the first air intake port 142 is opened, as the ship with the outboard motor 1 mounted thereon sails, an air outside the ship flows in through the first air intake port 142 which is opened forward of the upper engine cover 14A. As indicated by the dotted arrow A in FIG. 4B, the air taken in through the first air intake port 142 enters the expansion chamber 16, passes below a skirt portion 154*b* of a separator 154, and is then supplied to the throttle body 200 through an opening portion 153*a* of a guide seat 153 and an upper end opening portion 17*a* of a throttle body connecter 17.

At this time, the moisture and the like contained in the intake air and the water splashes are separated from gas by colliding with the separator 154 as indicated by the arrow W in FIG. 4B, and fall onto a bottom portion 151 of the under plate 15. Since the bottom portion 151 of the under plate 15 is an inclined surface sloping downward in the forward direction, the water flows down in the forward direction (i.e., in a direction opposite to the throttle body 200). The water which has flown down is collected in the front section of the bottom portion 151 and flows down into a drain pipe 18 through a drain hole 152. Then, the water is discharged outside the outboard motor 1.

Next, when the open/close member 144 of the second air intake ports 143 is opened, the outside air flows in through the second air intake ports 143 which is opened rearward of the upper engine cover 14A. As indicated by the dotted arrow A in FIG. 5B, the air taken in through the second air intake ports 143 enters the expansion chamber 16, passes below the skirt portion 154*b* of the separator 154, and is then supplied to the throttle body 200 through the opening portion 153*a* of the guide seat 153 and the upper end opening portion 17*a* of the throttle body connecter 17.

At this time, the moisture and the like contained in the intake air and the water splashes are separated from gas by colliding with the separator 154 as indicated by the arrow W in FIG. 4B, and fall onto the bottom portion 151 of the under plate 15. Since the bottom portion 151 of the under plate 15 is an inclined surface sloping downward in the forward direction, the water flows down in the forward direction (i.e., in a direction opposite to the throttle body 200). The water which has flown down is collected in the front section of the bottom portion 151 and flows down into the drain pipe 18 through the drain hole 152. Then, the water is discharged outside the outboard motor 1.

That is, even if the moisture and the like enter or intrude into the expansion chamber 6 through the first air intake port 142 or the second air intake ports 143, the moisture and the like are kept from flowing into an air inlet 110 of the throttle body 200 through the upper end opening portion 17*a* of the throttle body connecter 17. In particular, since the opening portion 153*a* of the guide seat 153 is provided near the rear portion of the expansion chamber 16, the water intruding into the expansion chamber 16 flows down in a direction apart from the air inlet 110 of the throttle body, thus making it possible to effectively prevent the water intruding into the expansion chamber 16 from flowing toward the air inlet 110 of the throttle body 200 or stagnating at apportion near the air inlet 110 of the throttle body.

Moreover, since the drain pipe 18 is provided with a backflow prevention mechanism, the water once discharged through the drain passage can be prevented from flowing back into the expansion chamber 16. In addition, no water will enter the expansion chamber 16 through the drain passage from the outside of the outboard motor 1.

The drain hole 152 is provided so as to be always located in the lowermost portion of the bottom portion 151 even when the outboard motor 1 tilts. Therefore, the water intruding into the expansion chamber 16 can be discharged outside quickly regardless of the attitude of the outboard motor 1.

As described above, the outboard motor 1 according to the present second embodiment is provided with two air intake port units including the first air intake port 142 and the second air intake ports 143. These air intake ports can be controlled manually or automatically by, for example, opening the first air intake port 142 and closing the second air intake ports 143 to take full advantage of ram pressure when the ship is sailing at a high speed while closing the first air intake port 142 and opening the second air intake ports 143 to prevent the entering or intruding of the moisture and the like when the ship is sailing at a low speed.

In the outboard motor 1 according to the second embodiment of the present invention, the first air intake port 142 takes an opened position when the lid member 141 is turned inward the engine cover 14A. Therefore, there is no protrusion on an outer side of the engine cover 14A, and there is no getting entangled in a fishing line or a fishing net.

As described above, in the outboard motor 1 according to the present second embodiment, the first air intake port 142 is formed in the upper engine cover 14A covering the upper portion of the outboard motor 1 and the first air intake port 142 is opened forward. According to such structure, since fresh sailing air can be caused to flow directly into the air intake port 142 when the ship sails, the air intake efficiency can be improved greatly in comparison with a structure in which an air intake port is provided only behind the engine cover, thereby making it possible to improve the combustion efficiency of the engine 21.

Furthermore, in the air intake structure of the outboard motor 1, the air taken in through the first air intake port 142 or the second air intake ports 143 is delivered and drawn into the air inlet 110 of the throttle body 200 in the space inside the upper engine cover 14A, i.e., in the expansion chamber 16. Further, in the air intake structure, the expansion chamber 16, which is formed as a space so as to communicate the first air intake port 142 and the second air intake ports 143 with the throttle body 200, is isolated from the engine room by the under plate 15. Therefore, the air intake structure is located above the engine 21 in the engine room in isolation from the engine 21.

The air taken in through the first air intake port 142 or the second air intake ports 143 enters the expansion chamber 16 and passes below the skirt portion 154*b* of the separator 154 as indicated by the dotted arrow A in FIG. 5B, and is then supplied to the air inlet 110 of the throttle body 200 through the opening portion 153*a* of the guide seat 153 and the upper end opening portion 17*a* of the throttle body connecter 17. In the manner mentioned above, the combustion air is supplied from the throttle body 200 to the engine 21 through an air passage formed in the space isolated from the engine room. That is, since the combustion air is not heated during flowing to the engine 21, while being exposed to the high temperature engine 21, the charging efficiency of the intake air becomes high, and hence, it makes possible to improve the combustion efficiency of the engine 21.

Furthermore, even if a large quantity of water intrudes through the air intake port 142, the intruding water drops onto a flat-plate portion 154*a* of the separator 154 and drops further onto the bottom portion 151 of the under plate 15 through the skirt portion 154*b*. Accordingly, the water intruding into the expansion chamber 16 will not enter the air inlet 110 of the throttle body 200 directly through the upper end opening portion 17*a* of the throttle body connecter 17. That is, the flat-plate portion 154*a* of the separator 154 constitutes a ceiling wall of the throttle body connecter 17 and a ceiling wall of the air inlet 110 of the throttle body 200 and hence, functions as a shield plate against the intruding water, thereby attaining the high water intrusion prevention effect. Further, since the lateral edge and rear edge of the flat-plate portion 154*a* are coupled to the inner wall surface of the under plate 15, no water will enter through the lateral edge and rear edge of the flat-plate portion 154*a*.

In the manner mentioned above, since the first air intake port 142 can be opened forward, it is made easier to take in air while keeping the water splashes and the like other than intake air away from the first air intake port 142, thus achieving the high air intake performance.

Since the first air intake port 142 is provided in an upper surface of the upper engine cover 14A covering the upper portion of the outboard motor 1, the first air intake port 142 is positioned at the highest level of the outboard motor 1, which eliminates or minimizes presence of obstacles and the like to incoming air in front of the first air intake port 142 to thereby obtains the smooth incoming air flow at the first air intake port 142. Moreover, since the first air intake port 142 is located at the higher level from the water surface, it is possible to effectively prevent sea spray and the like from entering or intruding.

Still furthermore, in the outboard motor 1, the throttle body 200 is disposed rearward of the first air intake port 142 to a portion spaced away from the first air intake port 142. That is, the first air intake port 142 is disposed on the forward side of the engine cover 14A while the throttle body connecter 17 is provided on the rearward side of the engine cover 14A. According to such manner, since a large distance is maintained between the first air intake port 142 and throttle body, the air passage for intake air can be increased according to the spacing distance, and it becomes easier to separate the moisture and the like contained in the intake air, making it possible to effectively prevent the water from intruding into the throttle body. In addition, by increasing the spacing distance between the first air intake port 142 and throttle body, it is also possible to increase the volume of the expansion chamber 16 to thereby increase the charging efficiency of intake air.

Furthermore, in the outboard motor 1 of the present embodiment, the lower end portion of the first air intake port 142 is positioned above the lower end portion of the skirt portion 154*b* of the separator 154. According to this structure, even if a large quantity of water intrudes through the first air intake port 142, the intruding water can be caused to drop reliably onto the top surface of the flat-plate portion 154*a* of the separator 154. Moreover, the water intruding through the first air intake port 142 contacts the flat-plate portion 154*a* or skirt portion 154*b* of the separator 154 before dropping onto the bottom portion 151 of the under plate 15. Accordingly, the large quantity of water intruding through the first air intake port 142 drops directly onto the bottom portion 151 of the under plate 15, thus making it possible to avoid an event in which splashes of water will enter the upper end opening portion 17*a* of the throttle body connecter 17.

Third Embodiment (FIGS. 1, 2, 6, and 7)

A third embodiment of the present invention will be described hereunder with reference to FIGS. 1, 2, 6 and 7.

It is to be noted that description of components common to those of the first and/or second embodiments (FIGS. 1 and 2) will be omitted or simplified herein.

Figure 6A:
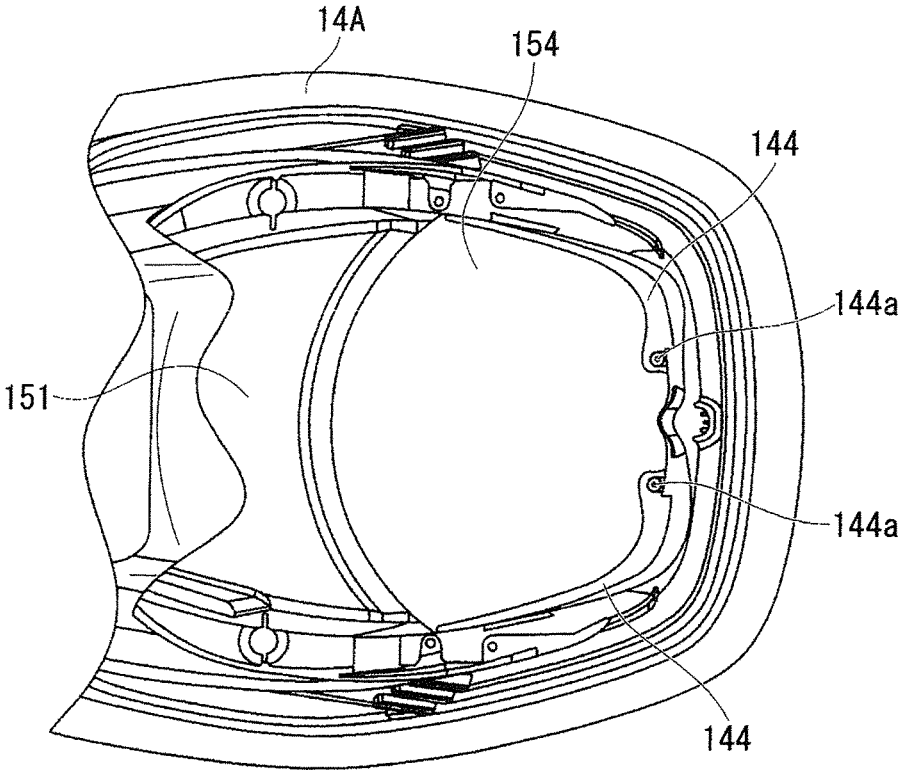
FIG. 6A is a schematic sectional view taken along the line VIA-VIA in FIG. 6B.
Figure 6B:
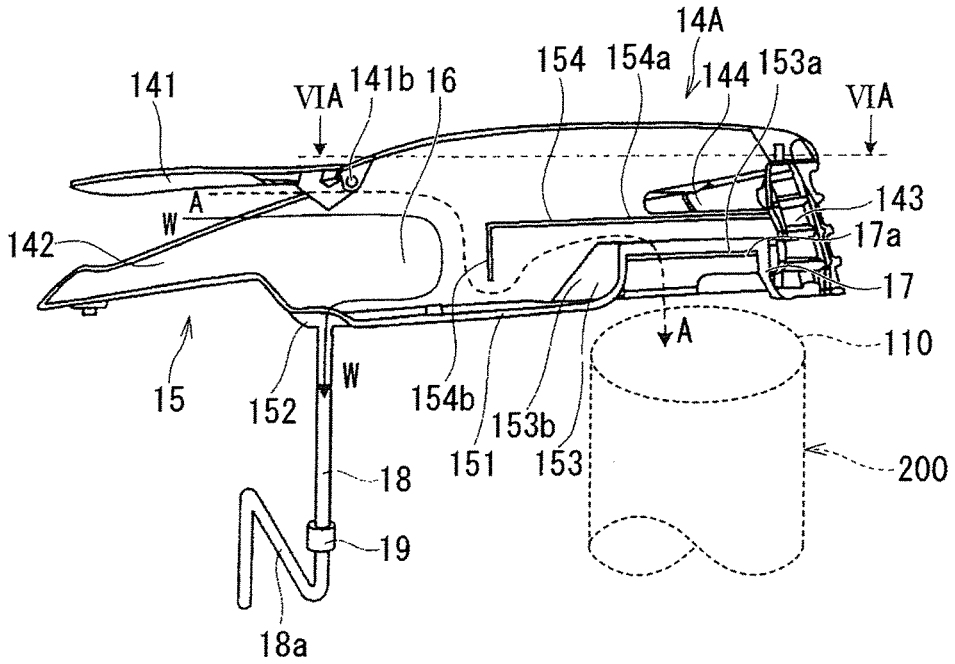
Figure 7A:
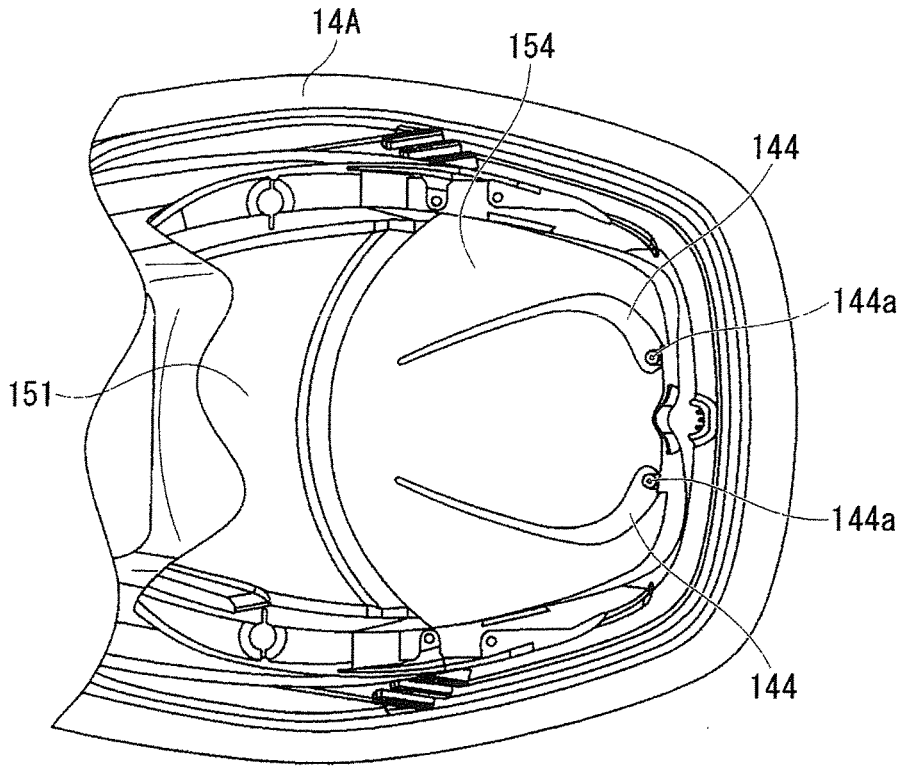
FIG. 7A is a schematic sectional view taken along the line VIIA-VIIA in FIG. 7B.
Figure 7B:
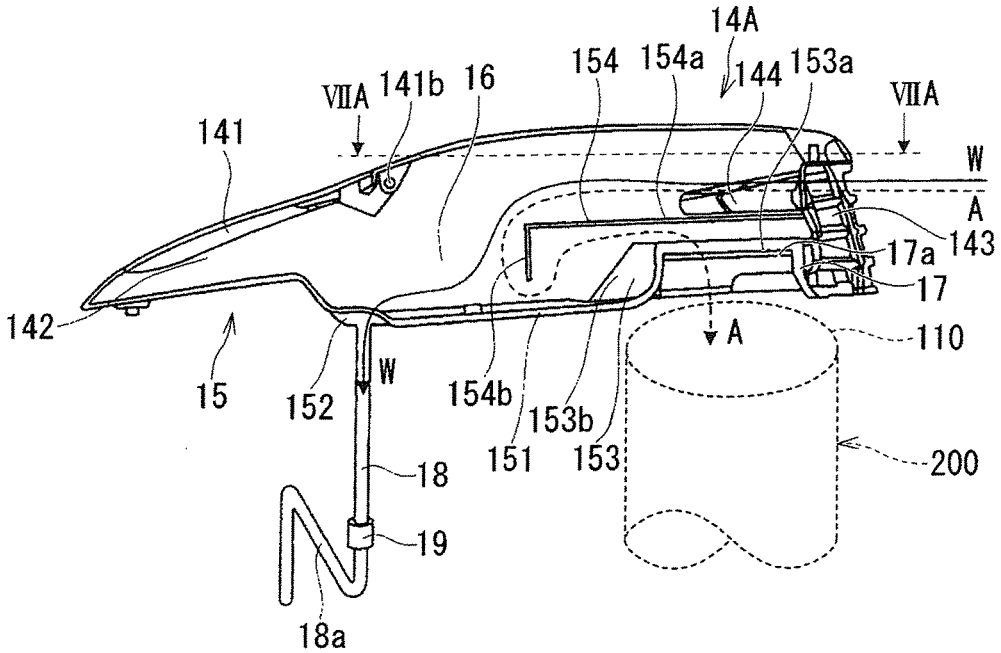

FIGS. 6 and 7 are schematic sectional views showing an upper engine cover 14A and its surroundings. FIG. 6A is a schematic sectional view taken along the line VIA-VIA in FIG. 6B. FIG. 7A is a schematic sectional view taken along the line VIIA-VIIA in FIG. 7B. The upper engine cover 14A is made by molding, for example, carbon fiber reinforced plastics (CFRP) or the like, as like as the first and second embodiments described above. Generally, the upper engine cover 14A has a shape opened downward, and the engine cover 14A approximately has an elliptical shape elongated in the front-and-rear direction in the top plan view and is curved convex upward as a whole.

The present third embodiment differs from the second embodiment in that the lid member 141 constituting a part of the cover is coupled to the outer side of the upper engine cover 14A on the front side of the upper engine cover 14A so as to be able to be pivotal (open/close) outward by means of hinge 141*b* provided to a rear portion. At an open position shown in FIG. 7B, the lid member 141 pivoting outward around the hinge 141*b* is fixed by opening the forward section of the upper engine cover 14A. At this time, the first air intake port 142 formed in the upper engine cover 14A becomes open. On the other hand, at a closed position shown in FIG. 7B, the lid member 141 pivoting outward around the hinge 141*b* is fixed by closing the forward section of the upper engine cover 14A. At this time, the first air intake port 142 formed in the upper engine cover 14A becomes closed.

Moreover, the upper engine cover 14A is provided, at a rear end portion, with a plurality of slit-shaped second air intake ports 143 substantially parallel to one another in the vertical (up-and-down) direction of the outboard motor 1. An open/close member 144 adapted to add an open/close function to the second air intake ports 143 is provided to the upper engine cover 14A. The open/close member 144 is fitted to the second air intake ports 143 and used to change the open/close state of the second air intake ports 143. At a closed position shown in FIG. 6A, the open/close member 144 is fixed by closing the second air intake ports 143. At this time, the second air intake ports 143 formed in the upper engine cover 14A is closed. Further, at an opened position shown in FIG. 7A, the open/close member 144 pivotally moves inward around the hinge 141*b* and is fixed by opening the second air intake ports 143. At this time, the second air intake ports 143 formed in the upper engine cover 14A become opened.

Furthermore, the upper engine cover 14A is generally composed of an upward convex curved surface so as to provide a round shape as a whole. The inner side of the upper engine cover 14A has an inner space approximately corresponding to the outer shape of the upper engine cover, and the inner and outer sides thereof are communicated with each other through the first air intake port 142 and second air intake ports 143.

It is further to be noted that an inner structure of the engine cover 14 according to this third embodiment as well as material, shape and associated structure of the under plate 15 are almost similar to those of the second embodiment shown in FIGS. 4 and 5, and hence, the same reference numerals are added to components corresponding to those of the second embodiment, and description thereof will hence be omitted herein.

Hereunder, the flow of combustion air supplied to the engine 21 in the outboard motor 1 according to the third embodiment of the structure described above will be explained.

When the lid member 141 is pivoted outward of the upper engine cover 14A on the hinge 141*b*, opening the first air intake port 142, as the ship with the outboard motor 1 mounted thereon sails, outside air flows in through the first air intake port 142 which is open forward of the upper engine cover 14A. As indicated by dotted arrow A in FIG. 6B, the air taken in through the first air intake port 142 enters the expansion chamber 16, passes under the skirt portion 154*b* of the separator 154, and is supplied to the throttle body 200 through the opening portion 153*a* of the guide seat 153 and the upper end opening portion 17*a* of the throttle body connecter 17.

The moisture and the like contained in the intake air and the water splashes taken in through the first air intake port 142 are treated with the same manner as that in the second embodiment, and hence, the description thereof will be omitted herein. Further, when the lid member 141 now in the opened state is pivoted inward around the hinge 141*b*, the lid member 141 pivoted inward closes down the first air intake port 142 to thereby block the inflow of the outside air.

On the other hand, when the second air intake ports 143 are opened, the flow of the outside air taken in is also similar to that of the second embodiment, and hence, the description thereof will be omitted herein.

The third embodiment of the present invention described above achieves functions and effects similar to those of the second embodiment described hereinbefore.

It is further to be noted that the present invention is not limited to the embodiments described above and can be embodied in various modified forms or modes. In the above embodiments, sizes and shapes illustrated in the accompanying drawings are not restrictive and may be changed as appropriate, as long as the advantageous effects of the present invention are achieved. In addition, the present invention may be changed or modified appropriately without departing from the scope of the present invention.

The air intake structure according to the present invention may be applicable not only to outboard motors, but also, for example, personal watercrafts and the like.

REFERENCE NUMERALS

1 - - - outboard motor, 2 - - - outboard motor body, 21 - - - engine, 22 - - - propeller, 23 - - - crankshaft, 24 - - - drive shaft, 25 - - - propeller shaft, 3 - - - mount bracket unit, 31 - - - clamp bracket, 32 - - - swivel bracket, 33 - - - swivel shaft, 4 - - - engine cover, 4A - - - upper engine cover, 4B - - - lower engine cover, 41 - - - bulging portion, 41A - - - inner space, 42 - - - air intake port, 43 - - - louver, 5 - - - under plate, 51 - - - bottom portion, 52 - - - discharge port, 53 - - - guide seat, 53*a* - - - opening portion, 53*b* - - - sloping portion, 54 - - - separator, 54*a* - - - flat-surface portion, 54*b* - - - skirt portion, 6 - - - expansion chamber, 7 - - - throttle body connecter, 7*a* - - - upper opening portion, 8 - - - discharge pipe, 8*a* - - - bent portion, 9 - - - one-way valve, 10 - - - throttle body air intake port, 100 - - - stern portion, 200 - - - throttle body, 14 - - - engine cover, 14A - - - upper engine cover, 14B - - - lower engine cover, 141 - - - lid member, 142 - - - first air intake port 143 - - - second air intake port, 144 - - - open/close member, 141*a*,

141*b* - - - hinge, 15 - - - under plate, 151 - - - bottom portion, 152 - - - discharge port, 153 - - - guide seat, 153*a* - - - opening portion, 153*b* - - - sloping portion, 154 - - - separator, 154*a* - - - flat-surface portion, 154*b* skirt portion, 16 - - - expansion chamber, 17 - - - throttle body connecter, 17*a* - - - upper opening portion, 18 - - - discharge pipe, 18*a* - - - bent portion, 19 - - - one-way valve, 110 - - - throttle body air intake port.

The invention claimed is:

1. An air intake structure for an outboard motor, the air intake structure comprising:

an air intake port formed in an engine cover covering upper portion of the outboard motor for taking in and providing air for delivery to a throttle body in order for the air to be drawn into the throttle body;

a first air intake port provided on a front side of the engine cover and configured to open forward in an advancing direction of the outboard motor;

a lid member configured to open and close the first air intake port;

a second air intake port provided on a rear side of the engine cover and configured to open rearward in the advancing direction of the outboard motor;

an open/close member configured to change an open/close state of the second air intake port; and a separator that performs gas/liquid separation and is provided in a space which communicates the first air intake port and the second air intake port with the throttle body, wherein the space is provided so as to be isolated from an engine room, the separator includes a flat-plate portion configured to cover an upper portion of an air inlet of the throttle body and a skirt portion formed by extending a front end portion of the flat-plate portion downward, and the second air intake port is formed in the rear side of the engine cover on an upper side of the flat-plate portion of the separator and on a rear side of the front end portion of the flat-plate portion such that air taken in through the second air intake port enters an upper space of the separator.

2. The air intake structure for an outboard motor of claim 1, wherein the lid member configured to open and close the first air intake port is a louver.

3. The air intake structure for an outboard motor of claim 1, further comprising:

a bulging portion formed on an upper surface of the cover so as to protrude therefrom; and an expansion chamber provided inside the engine cover with an inner space formed by the bulging portion, wherein air taken in through the first air intake port and air taken in through the second air intake port enter the expansion chamber, and wherein the expansion chamber is configured to convert dynamic pressure of the air taken in through the first air intake port into static pressure.

4. The air intake structure for an outboard motor of claim 1, wherein the throttle body is disposed rearward of the air intake port with a space from the air intake port.

5. The air intake structure for an outboard motor of claim 1, wherein a drain passage is provided so as to communicate an inner portion of the space with an outside portion and discharge water from the inner portion of the space to the outside portion, a backflow prevention mechanism is provided to the drain passage so as to prevent water from flowing into the inner portion of the space from the outside portion, and the backflow prevention mechanism is composed of at least one of an S-shaped pipe and a one-way valve.

6. The air intake structure for an outboard motor of claim 1, wherein the lid member of the first air intake port is pivotally coupled, at a front portion thereof, with the engine cover at a front portion of the engine cover covering the upper portion of the outboard motor, the lid member has a rear portion configured to turn inward of the engine cover to allow the first air intake port to be opened forward in the advancing direction of the outboard motor.

7. The air intake structure for an outboard motor of claim 6, wherein the open/close member is pivotally coupled to the inner portion of the engine cover and is configured to open and close the second air intake port.

8. The air intake structure for an outboard motor of claim 1, wherein the lid member of the first air intake port is pivotally coupled, at a rear portion thereof, with the engine cover at a front portion of the engine cover covering the upper portion of the outboard motor, the lid member has a front portion configured to turn outward of the engine cover to allow the first air intake port to be opened forward in the advancing direction of the outboard motor.

9. The air intake structure for an outboard motor of claim 8, wherein the open/close member pivotally is coupled to the inner portion of the engine cover and is configured to open and close the second air intake port according to the turn of the lid member.

* * * * *